United States Patent [19]

Hurtes

[11] 4,147,575

[45] Apr. 3, 1979

[54] MANUFACTURE OF NONWOVEN PILE ARTICLES

[76] Inventor: Walter Hurtes, 433 W. 34th St., New York, N.Y. 10001

[21] Appl. No.: 833,996

[22] Filed: Sep. 16, 1977

Related U.S. Application Data

[63] Continuation of Ser. No. 527,084, Nov. 25, 1974, abandoned, which is a continuation-in-part of Ser. No. 331,658, Feb. 12, 1973, Pat. No. 3,850,713.

[51] Int. Cl.[2] ..... D05C 15/00

[52] U.S. Cl. ..... 156/72; 28/104; 68/5 R; 156/435

[58] Field of Search ..... 156/62.2, 62.4, 72, 156/167, 176, 177, 180, 265, 272, 276, 297, 435, 436, 464, 494–496, 519, 68; 28/59, 61, 72 NW, 72.6, 52, 53; 68/5 R, 5A–E, 222; 19/161 R, 161 P; 428/85, 92; 139/67, 77; 222/196

[56] References Cited

U.S. PATENT DOCUMENTS

| | | | |
|---|---|---|---|
| 2,543,101 | 2/1951 | Francis | 156/62.2 |
| 2,706,072 | 4/1955 | Furno | 222/196 |
| 2,792,051 | 5/1957 | Jacquet | 156/72 |
| 3,499,807 | 3/1970 | Hurtes | 156/72 |
| 3,575,751 | 4/1971 | Mizell | 156/68 |
| 3,732,135 | 5/1973 | Ernst et al. | 156/72 |
| 3,850,713 | 11/1974 | Hurtes | 156/72 |

FOREIGN PATENT DOCUMENTS

| | | | |
|---|---|---|---|
| 790498 | 2/1958 | United Kingdom | 156/72 |
| 952819 | 10/1962 | United Kingdom | 68/5 B |
| 1031333 | 6/1966 | United Kingdom | 156/72 |

*Primary Examiner*—John E. Kittle

*Attorney, Agent, or Firm*—Cooper, Dunham, Clark, Griffin & Moran

[57] ABSTRACT

In procedure for making nonwoven pile articles by assembling an array of cut pile fibers or yarns having free ends disposed substantially in a common plane and adhering a backing to the free ends, the step of treating the fibers or yarns with steam after assembling the array but before applying the backing thereto.

8 Claims, 10 Drawing Figures

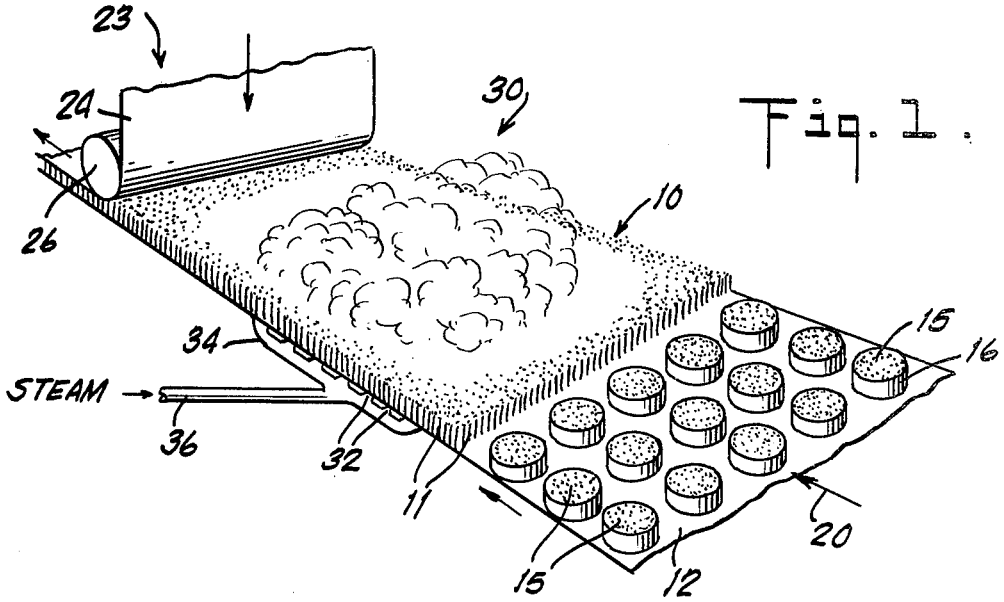
Fig. 1.
Fig. 2.
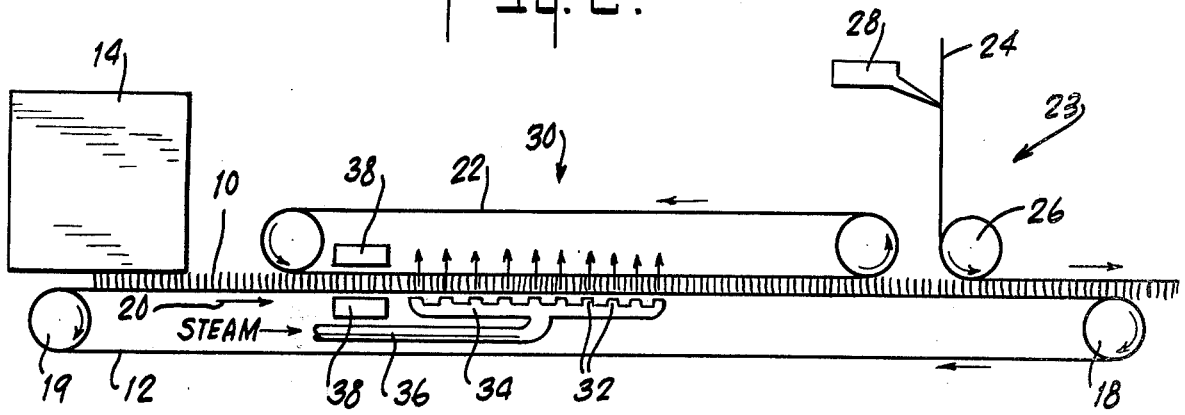
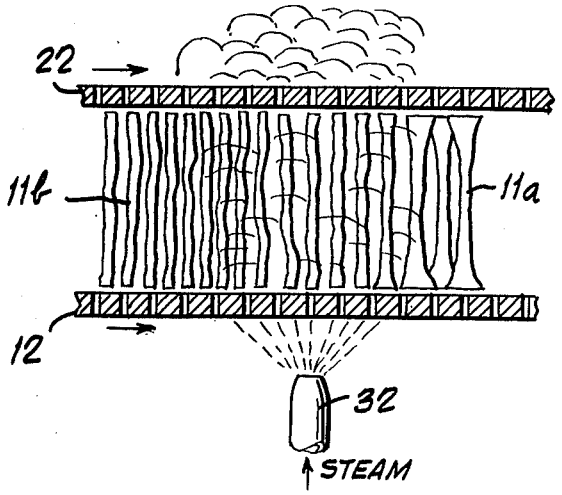
Fig. 3.

MANUFACTURE OF NONWOVEN PILE ARTICLES

CROSS-REFERENCE TO RELATED APPLICATIONS

This application is a continuation of application Ser. No. 527,084, filed Nov. 25, 1974, now abandoned, which is a continuation in part of application Ser. No. 331,658, filed Feb. 12, 1973, now U.S. Pat. No. 3,850,713 issuing on Nov. 26, 1974.

BACKGROUND OF THE INVENTION

This invention relates to procedures for making nonwoven pile articles, and more particularly to procedures of the type wherein an adherent backing is applied to the free ends of a pre-assembled array of cut pile yarns or fibers. For convenience of expression, the term "fibers" will be used herein to refer to yarns as well as to individual discrete fibers.

It is known to assemble an array of substantially aligned cut pile fibers having free ends disposed substantially in a common plane, and then to apply an adherent backing to the free ends of the assembled fibers, for production of a nonwoven pile article. Examples of such procedures are described in applicant's U.S. Pat. No. 3,499,807, and in applicant's copending U.S. patent applications Ser. No. 436,640 filed Jan. 25, 1974 (a continuation-in-part of U.S. Ser. No. 229,065 filed Feb. 24, 1972, now abandoned) and Ser. No. 331,658, mentioned above. Pile articles produced in this way may be used as carpets or for other purposes, and offer advantages especially with respect to ease of fabrication and economy of pile fiber consumption.

In procedures of the foregoing character, pile density is controlled or adjusted by performing appropriate operations on the assembled fibers prior to application of the backing. Although the aforementioned patent and applications describe effective ways of achieving such density control, it is found that (as also in more conventionally produced pile articles) spaces may remain between adjacent fiber ends where they join the backing, so that areas of exposed backing may be seen in the produced pile article when the pile fibers are separated. Presence of these exposed areas of the backing is undesirable since they tend to become visible as the pile depth decreases through wear, imparting a threadbare appearance to the article.

Heretofore, complete pile articles comprising a fiber pile adhered or otherwise secured to a backing have sometimes been treated with steam or hot water to alter the physical characteristics of the pile fibers and/or for other purposes. One effect of such treatment is a "blooming" or apparent densification of the free upper portions of the fibers. The blooming effect, however, does not alter the axial spacing of the fibers nor does it extend to the fiber ends which are anchored to the backing; hence it does not overcome the problem of exposure of areas of the backing between fibers and resultant threadbare appearance as the pile wears.

SUMMARY OF THE INVENTION

The present invention broadly contemplates the provision of procedure for making a nonwoven pile article by assembling an array of pile fibers having free ends disposed substantially in a common plane, and adhering a backing to the free ends of the fibers, wherein the improvement comprises exposing the fibers to steam after assembly of the array but prior to application of the backing. The steam treatment may, for example, be performed by directing jets of steam through a porous moving or stationary first surface while maintaining the fiber array disposed between the first surface and a second surface for preventing axial dislocation of the fibers. Alternatively, the array may be exposed to a relatively quiescent atmosphere of steam in a steam chamber. Desirably in most instances, the surface or surfaces in contact with the fibers during the steam treatment are preheated to prevent condensation of moisture.

By thus treating the fibers with steam before application of the backing (rather than afterwards, as in prior practice), the procedure of the present invention achieves a fiber blooming or apparent densification effect that very significantly extends to and includes those free ends of the fibers which are to be adhered to the backing. As a result, when the backing is subsequently applied, the bloomed free ends adhering to it substantially completely cover the entire backing surface, leaving little or no exposed area on the pile-bearing side of the backing. The pile therefore exhibits desirably uniform apparent density, with no "bald spots," even as it wears to a small fraction of its original depth.

Moreover, the treatment of the fibers with steam prior to application of the backing can be performed so as to effect, or to cooperate with other steps in effecting, density control of the fibers, i.e. to achieve desired axial spacing (and uniformity of distribution) of the free-ended fibers within the array. Since the fibers, when subjected to steam in accordance with the invention, are laterally movable relative to each other (rather than being anchored at one end in a backing), resultant blooming of the fibers can produce relative lateral movement of the fibers to space them further apart and/or more uniformly in the array. When the steam is applied in jets, the agitation caused by the jet currents additionally promotes relative lateral displacement of fibers for density control.

Further features and advantages of the invention will be apparent from the detailed description hereinbelow set forth, together with the accompanying drawings.

BRIEF DESCRIPTION OF THE DRAWINGS

FIG. 1 is a schematic side elevational view of apparatus for forming a nonwoven pile article, illustrating the practice of the present invention in a particular embodiment;

FIG. 2 is a further simplified perspective view of the pile-forming apparatus and procedure of FIG. 1;

FIG. 3 is an enlarged fragmentary side view illustrating application of steam as in the embodiment of FIG. 1;

DETAILED DESCRIPTION

Figure 4:
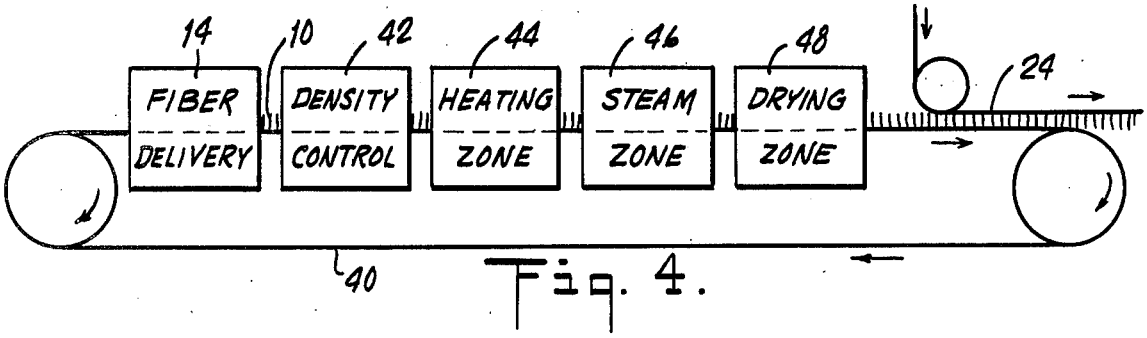
FIG. 4 is a largely diagrammatic side elevational view of a further pile-forming system in which the procedure of the present invention may be practiced.

Referring first to FIGS. 1 and 2, there is illustrated in simplified schematic view a system for producing a nonwoven pile article, e.g. a cut pile carpet, as generally set forth in applicant's aforementioned copending applications. In this system, an array 10 of cut pile fibers 11 is established on the upper run of an endless belt 12 by a fiber delivery device 14, for example a device of any of the types described in the aforementioned copending applications, to which reference may be made for details of construction and operation thereof. Stated broadly, the device 14 (FIG. 2) distributes on the upper surface of the belt 12 a plurality of pile units 15 (FIG. 1) each comprising a disc-shaped, cylindrical assembly of substantially aligned cut pile fibers having opposed free ends and held together in laterally compressed relation by a surrounding sleeve 16 of flexible, disposable material such as polyethylene film. The units 15 are deposited on the belt, as shown in FIG. 1, in successive rows of plural units with the lower free ends of the fibers of each unit engaging the belt surfaces. Upon or prior to deposit of the units, the sleeves are stripped therefrom by suitable means (not shown), releasing the contained fibers for expansion of the units (preferably under the influence of a force applied by appropriate means, not shown in FIGS. 1 and 2) into an essentially continuous array of pile fibers, extending across and along the belt upper surface.

In this array, the fibers are substantially aligned with each other and are supported by the belt in upstanding relation thereto with their lower free ends resting on the belt surface and their upper free ends disposed substantially in a common plane parallel to but spaced above the belt surface. The belt, which is trained over a drive roller 18 and a follower roller 19, advances the array 10 of fibers in the direction shown by arrows 20. Preferably, a second driven endless belt 22 (omitted from FIG. 1 for simplicity of illustration) lightly engages the upper free ends of the fibers in the array as they advance, to prevent accidental displacement of the fibers in an axial direction; as shown in FIG. 2, the lower run of belt 22 is driven in the same direction (and at the same velocity) as the subjacent upper run of belt 12.

At a locality 23 spaced from the device 14, and beyond belt 22, a continuous backing web 24 trained over a roller 26 comes into engagement with the upper free ends of the fibers of the array 10. An adhesive substance, applied to the surface of web 24 ahead of locality 23 by an applicator represented at 28, anchors the fibers endwise to the web to form a complete pile article, which may thereafter be subjected to curing treatment (not shown) e.g. of a conventional nature.

The foregoing procedure, which will be understood to be merely exemplary of operations with which the present invention may be practiced, is, as stated, fully described in applicant's aforementioned copending applications, and therefore need not be further detailed here.

In accordance with the invention, as incorporated in such procedure, the fiber array 10 is exposed to steam at a locality 30 intermediate the fiber delivery device 14 and the locality 23 at which the backing is applied to the fibers. As described above, the upper ends (as well as the lower ends) of the fibers at locality 30 are free, i.e. they are not adhered to each other or to a backing, although they may be restrained by belt 22 against vertical displacement. Similarly, the fibers themselves at locality 30 are free-standing in the sense that they are not positively restrained against lateral movement relative to each other and to the belt. Particularly important features and advantages of the invention reside in the exposure of the fibers to steam prior to application of an adherent backing to their ends, or in other words while the fiber ends which will be adhered to the backing are still free, but after the fibers have been assembled into a pile-forming array on the belt or other support surface.

As illustrated in FIGS. 1 and 2, a plurality of upwardly directed steam nozzles 32 are disposed beneath the upper run of belt 12 at locality 30, and are connected to a common header 34 to which steam is supplied from a suitable source (not shown) through a conduit 36. The belt 12 is fabricated of a material sufficiently porous (or perforate) to permit relatively free passage of steam therethrough, so that upwardly directed jets of steam from the nozzles 32 pass through the belt and through the array 10 of fibers. The upper belt 22 is preferably also porous to permit the steam to escape upwardly from the array. Desirably, the belts are preheated (i.e. before they come into contact with the steam) to a temperature high enough to prevent condensation of moisture on the belts and/or fibers; to this end, heating means for the belts, represented in FIG. 2 as generally conventional radiant heating elements 38, may be disposed adjacent the belts ahead of locality 30.

Thus, in the performance of the present procedure in the embodiment represented in FIGS. 1 and 2, the assembled fibers 11 in the array 10 advancing on belt 12 through locality 30 are subjected to jets of steam directed upwardly, i.e. transversely of the plane of the belt and generally parallel to the axial orientation of the fibers, from the nozzles 32. The steam, passing through and permeating the interstices of the fiber array, acts on the fibers to cause them to swell, spread, or bloom, much as the free extremities of fibers adhered to the backing of a complete pile article may be bloomed by a conventional steam treatment as heretofore known. That is to say, the physical effects of the steam on the individual fibers or groups of fibers (e.g. fibers twisted into yarns) may be similar to the effects heretofore produced on the free extremities of the pile fibers of a cut-pile article by steam treatment. In the present procedure, however, unlike such conventional treatment, the spreading effect operates on the upper free ends of the fibers (i.e. the ends which will be adhered to the backing) owing to the fact that the fibers are exposed to the steam before the backing is applied. Thus the latter free ends of the fibers are caused to bloom or spread by the steam, producing an effective densification of the fiber array in the plane in which it will be attached to the backing as well as in the parts of the fibers which will be remote from the backing. As a result, when the backing is applied, it engages already-bloomed fiber ends; these bloomed ends cover the backing surface substantially completely, virtually eliminating exposed portions of backing surface between adjacent fibers. Consequently, in the produced pile article, even very extensive wear of the pile does not create a threadbare appearance or bald spots.

The steam treatment of the present invention, as embodied, for example, in the procedure illustrated in FIGS. 1 and 2, also contributes to the control of density, and attainment of uniformity, in the ultimately produced pile. Since the fibers 10 of the array 11 are free-standing in the above-described sense at the locality 30, the blooming effect of the steam treatment tends to push the fibers apart laterally, i.e. to increase the spacing between the axes of adjacent fibers. As already explained, the fibers as delivered to the belt 12 are initially compressed within the pile units 15 to a density commonly greater than the desired ultimate pile density, and after release of the pile units (by stripping of the sleeves 16), the units are caused to expand laterally and merge into each other e.g. by application of appropriate force. This expansion, into a continuous array of substantially uniformly distributed fibers typically having a lower density (number of fibers per unit area) than the initial pile units, may be effected, wholly or partly, by the steam treatment. That is to say, the steam treatment may provide the sole or principal applied force promoting expansion of the pile units or may contribute to such expansion in cooperation with other application of force e.g. as described in the aforementioned copending applications.

As stated, one way in which the steam treatment produces this increase in spacing between fibers is by blooming or spreading the individual fibers. In addition, in the embodiment of FIGS. 1 and 2, the force of the upwardly directed jets promotes such spreading or lateral displacement of the fibers. The extent of displacement of fibers resulting from the steam treatment is dependent inter alia on the frictional forces exerted by the belt or belts on the fibers. Thus, if the belts are so-called high-friction belts, their engagement with the fiber ends inhibits lateral displacement of the fibers though it does not prevent blooming of the fiber ends; on the other hand, if the belts are low-friction belts, the fibers move apart relatively easily under the influence of the steam.

The effect of the steam treatment in laterally displacing the fibers contributes very significantly to desired uniformity of fiber distribution in the pile. As will be understood, in the expansion of the pile units on the belt surface, whether resulting simply from release of the pile units or promoted by applied forces, gaps or interstices of unequal size may remain between adjacent fibers in local areas of the array 10. When the fibers are exposed to steam at the locality 30, lateral displacement of fibers occurs preferentially into these gaps, where there is less resistance to such displacement, so that the uniformity of distribution of the fibers throughout the array is enhanced.

It will be appreciated that the lateral displacement of the fibers by the steam is again attributable to the fact that the fibers are subjected to the steam treatment before they are fixed to any backing. If the steam treatment were applied only to fibers already adhered to a backing, as in prior practice, the fibers would be held by the backing against lateral displacement although their free extremities could bloom and spread.

Use of the upper belt 22 is particularly desirable when the fibers are subjected, as in FIGS. 1 and 2, to jets of steam passing through the fiber array with substantial force. Belt 22 restrains the fibers against the vertical displacement that might otherwise occur owing to the force of the jets.

In addition to the preheating of the belts for prevention of condensation as described above, the array of fibers together with the supporting and restraining belts or surfaces may be subjected to drying after exposure to steam, if desired, for example by advancing the fiber array on the belt 12 through a drying chamber (not shown in FIGS. 1 and 2). Drying removes any excess moisture that may be present in the fibers as a result of the steam treatment without detracting from the blooming or spreading effect produced by the steam. Also if desired, the fibers of the array 10 may be subjected to a succession of steam treatments with or without intermediate or following drying stages, prior to application of the backing, in order to achieve progressive or stepwise blooming and spreading of the fibers.

It will be appreciated that the specific physical effects of the steam on the fibers are dependent on the nature of the fibers and the nature of the applied steam. Thus particular kinds of fibers may exhibit a greater or lesser degree of crimping and/or some reduction in axial length under exposure to steam. The type of steam employed, i.e. wet steam, dry steam, superheated steam, etc., may be selected by the operator for particular applications, as will be apparent to those skilled in the art from the effects of different types of steam treatment on different types of fibers already adhered to backings.

Although in FIGS. 1 and 2 the backing 24 is represented in the form of a web having adhesive applied to its surface for securing the fibers to the web, other types of backings may be employed. For example, a backing may be formed directly on the upper free ends of the array at locality 23 by spraying or applying onto the fiber free ends a fluid material which solidifies to constitute an adherent backing.

The effect of the steam treatment is further illustrated in FIG. 3 which shows the array of fibers 10 between concurrently advancing porous belts 12 and 22 during exposure to a jet of steam directed upwardly through the belts from one of the nozzles 32. The blooming effect of the steam on the fibers is schematically represented as an enlargement particularly at the upper and lower free ends of the fibers **11*a* on the right-hand or downstream side of the array as compared with the fibers 11*b* on the left-hand side of the array just entering the steam zone. The increase in axial spacing between adjacent fibers is also evident by comparison of the treated fibers 11*b* with the untreated fibers 11*a***.

While the procedure of the invention has been described as performed to treat an array of fibers carried on a moving endless belt, the fibers subjected to the treatment may be supported in other ways. For example, the fiber array 10 (having the same characteristics as described above) may be established on or delivered to a stationary perforate plate through which steam is passed, and after the steam treatment, a backing may be applied to the free ends of the fibers while they are still supported on the perforate plate. If jets of steam are used, directed perpendicularly to the plane of the perforate plate, a perforate top plate (corresponding positionally to belt 22) is preferably also employed to restrain the fibers against displacement in an axial direction. The arrangement of an array of fibers on a stationary perforate plate (with a retaining perforate top plate) may be understood from FIG. 3, if elements 12 and 22 are considered as stationary plates or support surfaces rather than moving belts.

FIG. 4 illustrates diagrammatically the incorporation of the present procedure in a system (for producing nonwoven pile carpets or other nonwoven pile articles) somewhat more complex than that shown in FIGS. 1 and 2. Means represented for simplicity as an endless belt 40 conveys the array of fibers 10 from the fiber delivery device 14 (which may be the same as that of FIG. 2) through density control mechanism 42 where, for example, the interfiber spacing may be increased to reduce the density of the pile array, for example as disclosed in the aforementioned copending applications. Belt 40 then successively conveys the fibers through a heating zone 44 where the belt and fibers are preheated, a steam zone 46 where the fibers are bloomed by exposure to steam, and an optional drying zone 48 where excess moisture remaining from the steam treatment may be removed as by application of heat in a dry atmosphere. The steam-treated fibers having bloomed free ends are finally carried by the belt 40 into contact with backing web 24 which has an adhesive-bearing surface for anchoring the fibers to the web to produce a complete pile article. If desired, between the fiber delivery device 14 and the locality of application of backing web 24, there may be provided a succession of density control mechanisms 42, e.g. for effecting stepwise increase in separation of fibers of the array 10, and each of these density control mechanisms 42 may be individually followed by a steam zone 46 to correct any nonuniformity in fiber distribution that may have been introduced into the array by the immediately preceding density control mechanism.

Illustrative examples of density control mechanisms, described in detail in one or more of the aforementioned copending applications, include fiber-carrying endless belts fabricated of an elastic material and subjected to progressive lateral or longitudinal expansion while supporting the fibers, as well as successions of belts driven at respectively different velocities.

Figure 5:
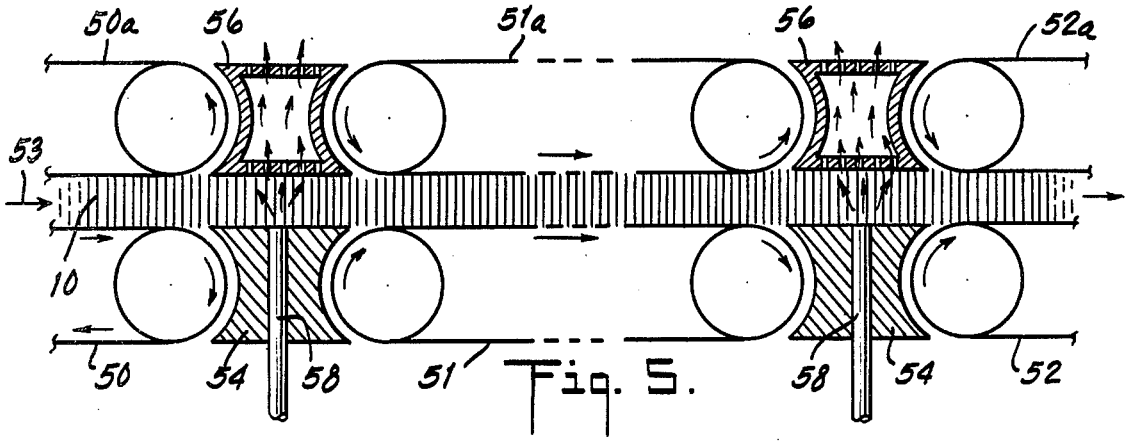
FIG. 5 is an enlarged fragmentary side elevational view in illustration of another embodiment of the invention.

Referring to FIG. 5, there are shown a succession of three belts 50, 51 and 52 having upper runs disposed in a common plane for sequentially supporting an array of fibers 10 advancing in the direction indicated by arrow 53. Belts 50, 51 and 52 may be respectively driven at successively greater velocities, i.e. belt 50 being the slowest of the three belts and belt 52 being the fastest. In this way, as the fibers of array 10 advance successively over the three belts in the direction of arrow 53, they become spaced progressively further apart, decreasing the overall density of the fiber array. With each of the belts 50, 51 and 52, there is associated a corresponding upper belt 50*a*, 51*a* or 52*a* having its lower run driven in the same direction and at the same velocity as the associated subjacent belt, to restrain the fibers of the array against vertical displacement.

It will be understood that the described arrangement of belts in FIG. 5 constitutes one form of density control mechanism for progressively reducing the density of a fiber array in a controlled manner determined by the relative velocities of the belts. Intermediate successive lower belts, stationary support members 54 are mounted to support the advancing fibers as they are transferred from one belt to the next. Corresponding stationary restraining members 56 are mounted above the members 54, between successive upper belts.

In accordance with the invention, each of the support members 54 may have one or more passages 58 formed in it and opening upwardly. Steam is supplied through passages 58 so as to pass upwardly therefrom through the advancing fiber array 10. The upper members 56 may, as shown, be hollow and perforate to conduct the steam away from the array of fibers.

In this embodiment of the invention, the successive applications of steam serve to bloom the fiber free ends in the manner already described prior to application of a backing thereto (the backing being applied beyond the downstream end of belts 52 and 52*a* in FIG. 5) and also serve to promote lateral displacement of the fibers so as to correct any nonuniformity of fiber distribution resulting from the fiber array-expanding stages. While differential speed belts have been specifically described as constituting the density control or array-expanding mechanism of FIG. 5, the belts 50, 51 and 52 (as also the belts 50*a*, 51*a* and 52*a*) may be elastic expanding belts which stretch progressively and thus progressively separate the fibers supported on them. These belts, whether of the differential speed or expanding type, are preferably high-friction belts; i.e. the free ends of the fibers are restrained by substantial frictional forces against movement relative to the belt surfaces so that the differential velocity or expanding effect of the belts promotes fiber separation. The surfaces of members 54 and 56 engaging the fiber ends may, by contrast, be low-friction surfaces on which the fiber ends can move readily to maximize the effect of the steam in promoting fiber displacement for filling gaps in the array. It will of course be appreciated that the fibers supported on the surface of elements 54 are pushed forwardly (in the direction of arrow 53) by the advancing belt-transported fibers behind them.

Figure 6:
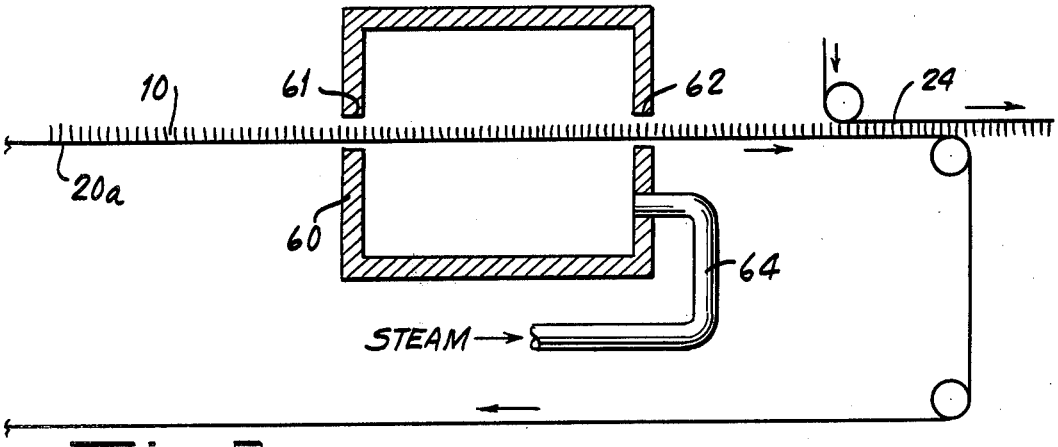
FIG. 6 is a schematic side elevational view in illustration of a further modified embodiment of the invention.

FIG. 6 illustrates an alternative arrangement for exposing the fibers of an array 10 to steam. In FIG. 6, the fiber array 10 (established, as in the preceding embodiments of the invention, by a suitable delivery device on the upper surface of the upper run of a driven endless belt 20*a*) is advanced through a substantially fully enclosed chamber 60 having opposed lateral ports 61 and 62 to accommodate the belt and fiber array. Steam supplied to the chamber 60 through a conduit 64 fills the chamber with a more or less quiescent atmosphere of steam which permeates the fibers of the array 10 within the chamber and causes blooming especially at the free ends of the fibers. In this embodiment, the fibers are not subjected to the additional displacing effect of a directional flow or jet of steam, but the steam atmosphere produces the desired blooming or spreading of the individual fibers. As before, the belt and fibers may be preheated by suitable and e.g. conventional heating means (not shown) ahead of the locality of exposure to steam and may if desired be dried as by heating after exposure to steam. Beyond the steam chamber 60, belt 20*a* carries the array of bloomed fibers into contact with backing web 24, which has an adhesive surface to which the fibers adhere, forming a complete pile article.

Figure 7:
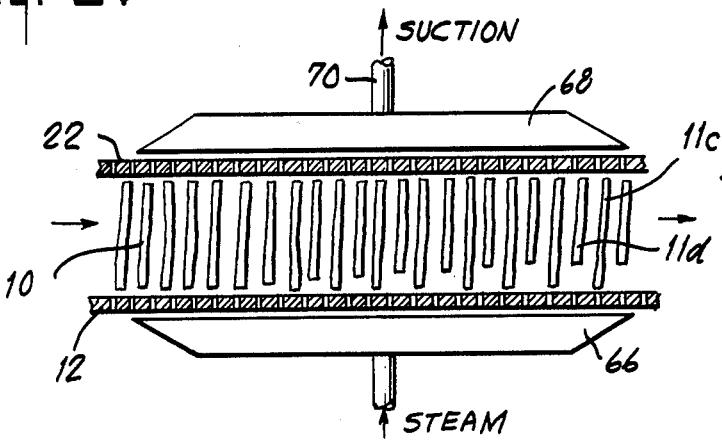
FIG. 7 is an enlarged fragmentary side elevational view in illustration of still another embodiment of the invention.

A further arrangement for applying steam in accordance with the invention to an array of fibers is shown in FIG. 7. The array 10, supported as in FIG. 2 on lower porous belt 12 and restrained by upper porous belt 22, is advanced (before application of a backing) past a locality where steam is directed upwardly through the belt 12 and thence through the fiber array 10 from a distributor 66 positioned immediately beneath the belt 12 and opening upwardly. A suction plate 68 to which suction is applied as through a conduit 70 overlies belt 22 in opposed relation to the distributor 66. The suction plate 68 not only helps to draw steam upwardly through the array 10 from the distributor 66, but also tends to hold the upper free ends of the fibers against the belt 22. This latter effect is particularly desired when the array 10 is constituted of heterogeneous fibers having respectively different axial shrinkage properties under exposure to steam.

More specifically, in FIG. 7 the array 10 is shown as constituted of fibers 11*c* which exhibit relatively little axial shrinkage under exposure to steam in mixture with fibers 11*d* which exhibit relatively greater axial shrinkage when exposed to steam. As fibers 11*d* shorten during passage through the steam locality, their upper free ends are held by the suction plate 68 against the upper belt 22 so that they shrink upwardly away from belt 12, but their upper ends remain in desired coplanar relation with the upper ends of fibers 11*c* for subsequent application of a backing to these upper ends.

Figure 8:
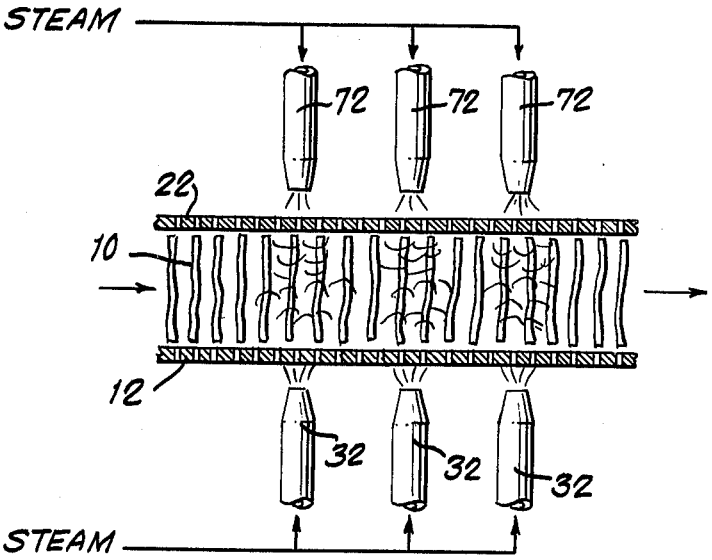
FIG. 8 is a similar view illustrating a further embodiment of the invention.

In the foregoing description, reference has been made to use of nozzles supplying upwardly directed jets of steam to a fiber array 10. Alternatively, the steam may be supplied through downwardly directed jets from above the array of fibers, indeed with good effect in maximizing the blooming of the upper free ends of the fibers for subsequent attachment to a backing. As shown in FIG. 8, which represents a modification of the FIG. 2 arrangement, the nozzles 32 directing steam upwardly through porous belt 12 into the array 10 may be supplemented by further downwardly oriented nozzles 72 disposed above belt 22, for directing jets of steam downwardly into the array 10, i.e. so that the array is exposed to steam jets simultaneously applied from both above and below.

Figure 9:
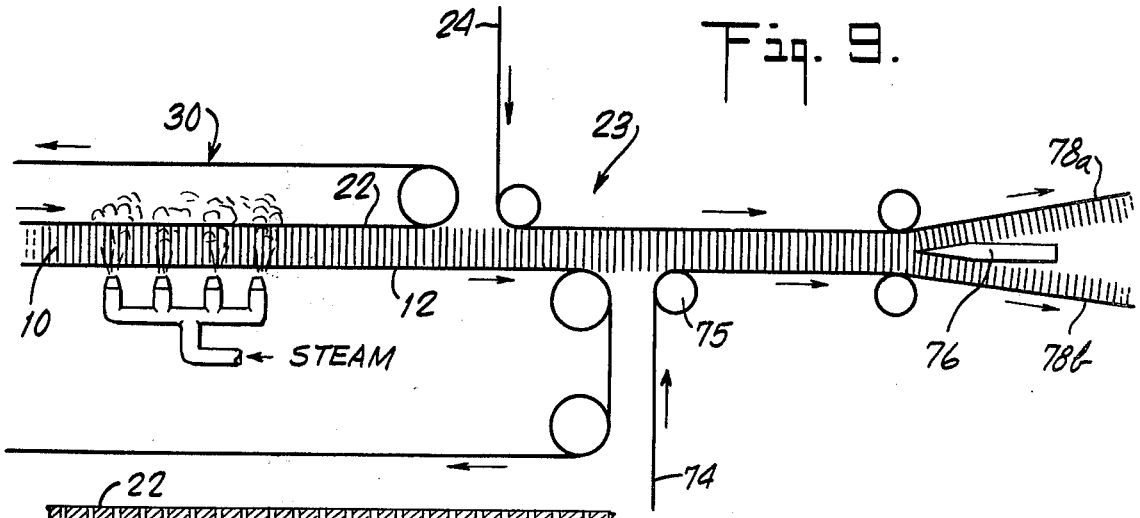
FIG. 9 is a schematic side elevational view of yet another system in which the present invention may be practiced.

A still further modification of the invention is illustrated in FIG. 9. The arrangement of FIG. 9 is similar to that of FIG. 1, i.e. including an array of fibers 10 advancing on a lower belt 12 (and restrained against upward vertical displacement by an upper belt 22) through a locality 30 where the array is exposed to steam supplied through nozzles 32, and thence to a locality 23 where a backing web 24 having an adhesive surface is applied to the bloomed upper free ends of the fibers.

The arrangement of FIG. 9, however, further includes provision of a second backing web 74, trained around a roller 75 and having adhesive applied to its surface from a source (not shown). This backing web 74 is applied to the lower free ends of the fibers of array 10 which are thus sandwiched endwise between the upper and lower adherent backing webs 24 and 74. In accordance with a further feature of operation known in the art, the pile array 10 between the adherent backings 24 and 74 is subsequently sliced laterally as by a knife 76 to produce simultaneously two cut pile articles 78*a* and 78*b*. In this FIG. 9 arrangement, the blooming effect of the steam on both the upper and lower free ends of the fibers at locality 30, i.e. prior to adherence of any fiber ends to a backing, produces in both pile articles 78*a* and 78*b* substantially total coverge of the backing surface by the adhered fiber ends and resultant freedom from bare spots as the pile wears in service.

Figure 10:
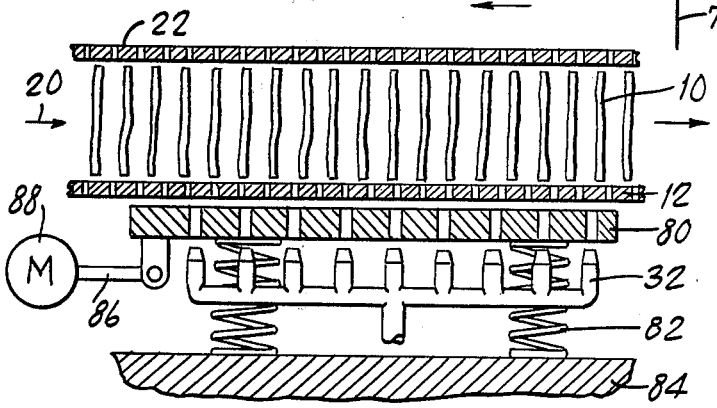
FIG. 10 is an enlarged fragmentary side elevation view of a further embodiment of the invention incorporating the use of vibration means.

A particularly effective way of achieving expansion of a pile fiber array to a desired and uniform density is by mechanically agitating the array. One arrangement for effecting such agitation in conjunction with application of steam (e.g. in a system of the general type of FIGS. 1 and 2) is illustrated in FIG. 10. As there shown, the fibers in the array 10, disposed between porous belts 12 and 22, are advancing in the direction of arrow 20 toward the locality of application of a backing. The lower belt 12 is supported on a perforate plate 80, which is in turn supported on springs 82 on a fixed mount 84. Plate 80 is connected through linkage 86 to means shown as a motor 88 for mechanically agitating the plate, and thus the belt 12 with the fibers disposed thereon, in directions which may be transverse and/or parallel to the plane of the belt. As the motor is operated to provide the described agitation, steam is supplied through nozzles 32 beneath the plate 80, and passes upwardly through the plate perforations and the porous belt 12 into the fiber array. The agitation or vibration imparted to the fibers promotes their lateral separation even as the steam acts to bloom them, and can be controlled to provide a desired extent of separation, i.e. a desired pile density.

This combination of steam and agitation or vibration may be employed advantageously, for example, in expanding the pile units 15 of FIG. 1 (after their sleeves 16 are removed) into a uniform continuous fiber array. Moreover, while belts have been referred to above, the agitation may be applied to a plate on which the fibers are supported, prior to applying a backing to the fibers. Application of agitation to the fibers before and/or after steam treatment also effectively promotes expansion of the array to a desired density.

It is to be understood that the invention is not limited to the features and embodiments hereinabove specifically set forth but may be carried out in other ways without departure from its spirit.

I claim:

1. In procedure for making a nonwoven pile article, the steps of (a) assembling an array of substantially axially aligned cut pile fibers having first and second free ends with the first free ends disposed substantially in a common plane;

(b) passing a directional flow of steam through said array in a direction substantially parallel to the axes of said fibers while (c) supporting said fibers on a first surface in a free-standing condition in which the fibers are laterally displaceable relative to each other in maintained substantially axial alignment and while (d) restraining said fibers against substantial axial displacement by maintaining a second surface in spaced parallel relation to said first surface with the fibers of said array extending between said first and second surfaces, at least one of said surfaces being pervious to steam, (e) said flow of steam being passed through said one pervious surface toward the other of said surfaces with sufficient force for effecting lateral displacement of the fibers relative to each other;

(f) heating said surfaces and said array before passing said flow of steam therethrough for preventing condensation of moisture thereon from the flow of steam;

(g) mechanically agitating said first surface while said flow of steam is being passed through said array, by vibrating the first surface, for laterally displacing the fibers of the array relative to each other in maintained substantially axial alignment in such manner as to achieve a uniform pile density in the array while the fibers are being exposed to steam; and (h) thereafter applying an adherent backing to said first free ends to form a pile article in which said array constitutes the pile.

2. Procedure according to claim 1, wherein the assembling step comprises assembling a plurality of rows of pile units, each comprising a substantially radially symmetrical and initially laterally compressed bundle of substantially axially aligned free-ended fibers, in side-by-side relation with the fibers of the pile units released from lateral compression, each of said rows comprising a plurality of said pile units.

3. Procedure according to claim 1, wherein the assembling step and the applying step are performed at spaced localities, and including the step of conveying said array between said localities, and wherein the steam-passing, supporting and restraining steps are performed during the conveying step.

4. Procedure according to claim 1, wherein the steam-passing step comprises directing jets of steam through said one pervious surface along paths substantially perpendicular thereto.

5. Procedure according to claim 1, wherein the assembling step comprises assembling an array of cut pile fibers which undergo effective dimensional modification upon exposure to steam.

6. In procedure for making a nonwoven pile article, the steps of (a) assembling, at a first locality, an array of substantially axially aligned cut pile fibers having first and second free ends with the first free ends disposed substantially in a common plane;

(b) conveying said array from said first locality to a second locality while exposing said array to steam; and (c) applying an adherent backing to said first free ends at said second locality to form a pile article in which said array constitutes the pile;

wherein the improvement comprises (d) the conveying step comprising advancing the array between successive pairs of endless belts each comprising an upper belt and a lower belt, said lower belts having surfaces that engage and exert relatively high frictional forces on the first ends of the fibers, and between at least one pair of stationary members comprising an upper member and a lower support member having a support surface, intermediate said endless belts, that exerts relatively low frictional forces on the first ends of the fibers; and (e) the exposing step comprising exposing the fibers to steam while the fibers are passing across the last-mentioned support surface.

7. In procedure for making a nonwoven pile article, the steps of (a) assembling an array of substantially axially aligned cut pile fibers having first and second free ends with the first free ends disposed substantially in a common plane;

(b) exposing said array to steam while (c) supporting said fibers on a surface in a free-standing condition in which the fibers are laterally displaceable relative to each other in maintained substantially axial alignment;

(d) heating said surface and said array before exposing said array to steam for preventing condensation of moisture thereon from the flow of steam;

(e) mechanically agitating said surface while said array is exposed to steam as aforesaid, by vibrating the surface, for laterally displacing the fibers of the array relative to each other in maintained substantially axial alignment; and (f) thereafter applying an adherent backing to said first free ends to form a pile article in which said array constitutes the pile.

8. In procedure for making a nonwoven pile article, the steps of (a) assembling an array of substantially axially aligned pile fibers having free ends disposed substantially in a common plane;

(b) exposing said array to steam while (c) supporting said fibers, by means of support structure, in a condition in which the fibers are laterally displaceable relative to each other in maintained substantially axial alignment;

(d) mechanically agitating said support structure while said array is being exposed to steam, by vibrating the support structure, for laterally displacing the fibers of the array relative to each other in maintained substantially axial alignment; and (e) thereafter applying an adherent backing to said free ends to form a pile article.

* * * * *